US010746175B2

(12) United States Patent
Takahashi et al.

(10) Patent No.: US 10,746,175 B2
(45) Date of Patent: Aug. 18, 2020

(54) SCROLL COMPRESSOR WITH SUCTION PIPE IMPROVEMENTS

(71) Applicant: DAIKIN INDUSTRIES, LTD., Osaka-shi, Osaka (JP)

(72) Inventors: Nobuo Takahashi, Osaka (JP); Yasuhiro Murakami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/628,000

(22) PCT Filed: May 9, 2018

(86) PCT No.: PCT/JP2018/017927
§ 371 (c)(1),
(2) Date: Dec. 31, 2019

(87) PCT Pub. No.: WO2019/008892
PCT Pub. Date: Jan. 10, 2019

(65) Prior Publication Data

US 2020/0217315 A1 Jul. 9, 2020

(30) Foreign Application Priority Data

Jul. 5, 2017 (JP) ..... 2017-132002

(51) Int. Cl.
*F04C 18/02* (2006.01)
*F04B 39/00* (2006.01)

(52) U.S. Cl.
CPC ..... *F04C 18/0215* (2013.01); *F04B 39/00* (2013.01); *F04C 2240/806* (2013.01)

(58) Field of Classification Search
CPC . F04C 18/0215; F04C 2240/806; F04B 39/00
See application file for complete search history.

(56) References Cited

U.S. PATENT DOCUMENTS 4,673,339 A * 6/1987 Hayano ..... F04C 18/0215 418/15
5,630,712 A * 5/1997 Sakai ..... F04C 18/0215 418/55.4

FOREIGN PATENT DOCUMENTS

JP 2007-327691 A 12/2007
JP 2017-15058 A 1/2017

OTHER PUBLICATIONS

International Preliminary Report of corresponding PCT Application No. PCT/JP2018/017927 dated Jan. 16, 2020.

(Continued)

*Primary Examiner* — Mary Davis
(74) *Attorney, Agent, or Firm* — Global IP Counselors, LLP

(57) ABSTRACT

A scroll compressor includes a casing having a cylindrical barrel and lid, a compression mechanism having fixed and movable scrolls, and a suction passage that sends a fluid into a compression chamber. The fixed scroll includes a fixed-side end plate, a fixed-side wrap standing upright on the fixed-side end plate, and a suction hole. The suction hole is capable of communicating with the compression chamber. The suction passage includes an insertion pipe portion inserted into a through hole of the lid, and an in-plate passage formed in the fixed-side end plate and having an outflow opening opened toward the suction hole. A center of the through hole is closer to an axis of the barrel than a center of the outflow opening of the in-plate passage. An entirety of the suction passage is positioned radially outward of a portion, of the through hole, closest to the axis of the barrel.

7 Claims, 6 Drawing Sheets

(56) References Cited

OTHER PUBLICATIONS

International Search Report of corresponding PCT Application No. PCT/JP2018/017927 dated Aug. 7, 2018.

* cited by examiner

SCROLL COMPRESSOR WITH SUCTION PIPE IMPROVEMENTS

CROSS-REFERENCE TO RELATED APPLICATIONS

This U.S. National stage application claims priority under 35 U.S.C. § 119(a) to Japanese Patent Application No. 2017-132002, filed in Japan on Jul. 5, 2017, the entire contents of which are hereby incorporated herein by reference.

BACKGROUND

Field of the Invention

The present invention relates to a scroll compressor.

Background Information

A scroll compressor has been known as a compressor for compressing fluid.

A scroll compressor described in Unexamined Japanese Patent Publication No. 2017-15058 includes a casing, a compression mechanism having a fixed scroll and a movable scroll, and an electric motor for driving the movable scroll to rotate. The casing has a cylindrical barrel and a lid (upper end plate) for closing an axial end of the barrel, and houses the compression mechanism and the electric motor. The fixed scroll includes a fixed-side end plate, and a spiral-shaped fixed-side wrap standing upright on a lower surface of the fixed-side end plate. The movable scroll includes a movable-side end plate, and a movable-side wrap standing upright on an upper surface of the movable-side end plate. The fixed-side wrap and the movable-side wrap mesh with each other to form a fluid compression chamber therebetween.

The scroll compressor is provided with a suction pipe that penetrates the lid of the casing and extends toward the compression mechanism. A suction hole that can communicate with the compression chamber is formed in a portion of the fixed scroll corresponding to an outermost portion of the fixed-side wrap. The suction pipe axially penetrates the fixed-side end plate of the fixed scroll, and a lower end (outflow opening) thereof is open in the suction hole.

When the movable scroll is rotated by the electric motor, the fluid in the suction pipe is introduced into the compression chamber via the suction hole. As the capacity of the compression chamber gradually decreases along with the rotation of the movable scroll, the fluid is compressed. The compressed fluid is discharged to the outside of the compression mechanism from a discharge port.

SUMMARY

In the scroll compressor as described above, the compression mechanism may be enlarged radially outward to increase the capacity of the compression chamber. When the compression mechanism is enlarged radially outward, the position of the suction hole for introducing the fluid into the compression chamber is also shifted radially outward. Further, a through hole in the lid of the casing, through which the suction pipe passes to be connected to the suction hole, is also shifted radially outward. Thus, the through hole becomes closer to the barrel of the casing. As a result, a bent portion of the lid which is bent toward the barrel becomes closer to the through hole, making processing, such as welding for connecting the suction pipe, difficult.

In view of the foregoing problems, it is an object of the present invention to provide a scroll compressor which can enlarge a compression mechanism radially outward, and can facilitate processing required for connection of a pipe to a lid of a casing.

A first aspect of the invention is directed to a scroll compressor including: a casing (20) having a cylindrical barrel (21) and a lid (22) attached to an axial end of the barrel (21); a compression mechanism (40) having a fixed scroll (41) and a movable scroll (51), and being housed in the casing (20); and a suction passage (C) sending a fluid outside the casing (20) into a compression chamber (57) of the compression mechanism (40). The fixed scroll (41) includes a fixed-side end plate (42), a fixed-side wrap (44) standing upright on the fixed-side end plate (42), and a suction hole (46) formed in a portion corresponding to an outermost portion of the fixed-side wrap (44), the suction hole (46) being capable of communicating with the compression chamber (57). The suction passage (C) includes an insertion pipe portion (65, 91) inserted into a through hole (83) of the lid (22) of the casing (20), and an in-plate passage (73, 92, 94) formed in the fixed-side end plate (42) and having an outflow opening (78) opened toward the suction hole (46). A center (p2) of the through hole (83) is closer to an axis (P) of the barrel (21) than a center (p1) of the outflow opening (78) of the in-plate passage (73, 92, 94).

In the first aspect of the invention, a refrigerant flowing through the suction passage (C) is introduced into the compression chamber (57) via the suction hole (46). When the movable scroll (51) revolves, the capacity of the compression chamber (57) decreases, and the refrigerant is compressed in the compression chamber (57).

In the present invention, the suction passage (C) is configured such that the center (p1) of the outflow opening (78) of the suction passage (C) is located closer to the axis (P) of the barrel (21) than the center (p2) of the through hole (83). Thus, even if the compression mechanism (40) is enlarged radially outward and the suction hole (46) is brought close to the barrel (21), the outflow opening (78) of the suction passage (C) can be connected to the suction hole (46).

On the other hand, the center (p2) of the through hole (83) into which the insertion pipe portion (65, 91) of the suction passage (C) is inserted is closer to the axis (P) of the barrel (21) than the center (p1) of the outflow opening (78). This configuration can avoid interference of the through hole (83) or the insertion pipe portion (65, 91) with a bent portion of the lid (22). Consequently, it is possible to avoid difficulty in forming the insertion pipe portion (65, 91) of the lid (22) of the casing (20).

A second aspect of the invention is an embodiment of the first aspect. In the second aspect, the insertion pipe portion is comprised of an upstream pipe portion (65, 91) extending coaxially with the center (p2) of the through hole (83), and the in-plate passage is comprised of a downstream pipe portion (73, 92) displaced toward the barrel (21) with respect to the upstream pipe portion (65, 91) so as to be coaxial with the center of the outflow opening (78).

In the second aspect of the present invention, the suction passage (C) can be comprised of the upstream pipe portion (65, 91) coaxial with the through hole (83), and the downstream pipe portion (73, 92) coaxial with the outflow opening (78).

A third aspect of the invention is an embodiment of the second aspect. In the third aspect, the upstream pipe portion (65, 91) and the downstream pipe portion (73, 92) are different members.

In the third aspect of the invention, the upstream pipe portion (65, 91) and the downstream pipe portion (73, 92), which are separate members, are joined together to form the suction passage (C).

According to the present invention, the center (p2) of the through hole (83) of the lid (22) of the casing (20) is brought closer to the axis (P) of the barrel (21) than the center (p1) of the outflow opening (78) of the suction passage (C). Thus, even if the suction hole (46) of the compression mechanism (40) is positioned radially outward, the outflow opening (78) of the suction passage (C) can be reliably connected to the suction hole (46). Further, the through hole (83) can be avoided from interfering with the bent portion of the lid (22), which can facilitate the connection of the pipe to the lid (22).

DETAILED DESCRIPTION OF EMBODIMENT(S)

Figure 1:
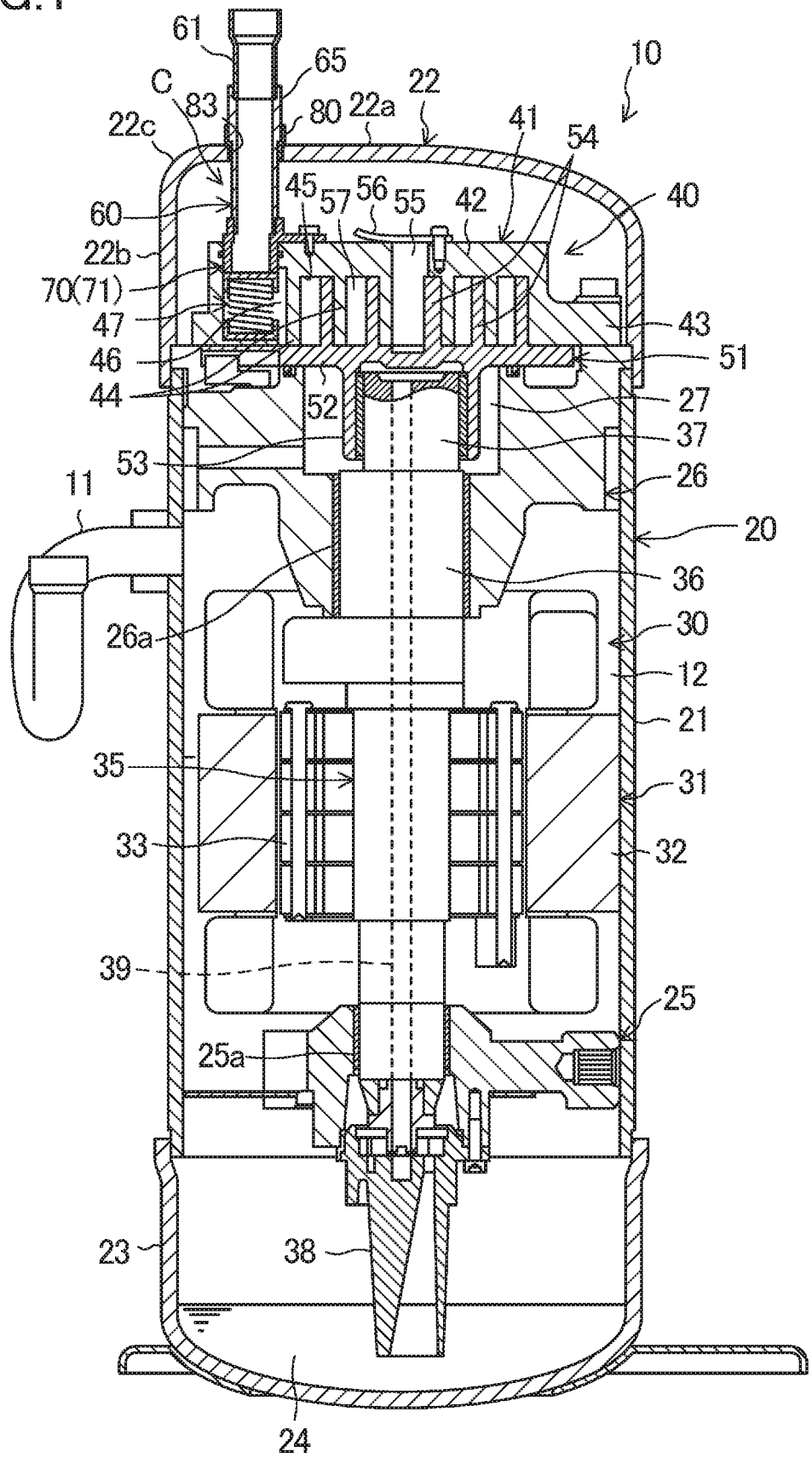
FIG. 1 is a vertical cross-sectional diagram illustrating the general configuration of a scroll compressor according to an embodiment.

Embodiments of the present invention will be described in detail below with reference to the drawings. The embodiments below are merely exemplary ones in nature, and are not intended to limit the scope, applications, or use of the present invention.

A scroll compressor (10) according to an embodiment of the present invention is connected to a refrigerant circuit performing a refrigeration air conditioning cycle. The refrigerant circuit is applied to, for example, an air conditioner.

The scroll compressor (10) includes a casing (20), a driving mechanism (30) housed in the casing (20), and a compression mechanism (40) housed in the casing (20).

The casing (20) is a vertically oriented, cylindrical hermetic container with both ends closed. The casing (20) includes a cylindrical barrel (21) with open ends, an upper end plate (22) (lid) fixed to an upper end of the barrel (21), and a lower end plate (23) fixed to a lower end of the barrel (21). An oil reservoir (24) for storing lubricant is formed at the bottom of the casing (20).

The driving mechanism (30) includes an electric motor (31), and a drive shaft (35) which is driven to rotate by the electric motor (31). The electric motor (31) includes a stator (32) and a rotor (33). The stator (32) is formed in substantially a cylindrical shape, and has an outer peripheral surface fixed to the barrel (21). A substantially cylindrical rotor (33) is disposed inside the stator (32). The drive shaft (35), which passes through the rotor (33) in the axial direction, is fixed within the rotor (33). The drive shaft (35) includes a main shaft (36), and an eccentric portion (37) projecting upward from an upper end of the main shaft (36).

A lower bearing member (25) is provided under the electric motor (31). A lower bearing (25*a*) is provided inside the lower bearing member (25). A housing (26) is provided above the electric motor (31). An upper bearing (26*a*) is provided inside the housing (26). The main shaft (36) of the drive shaft (35) is rotatably supported by the lower bearing (25*a*) and the upper bearing (26*a*).

The eccentric portion (37) of the drive shaft (35) is eccentric by a predetermined amount in the radial direction with respect to the axis of the main shaft (36). An oil pump (38) for conveying oil in the oil reservoir (24) is provided at a lower end of the main shaft (36) of the drive shaft (35). An oil supply passage (39) is formed inside the drive shaft (35). The oil pumped by the oil pump (38) is supplied to sliding portions, such as the compression mechanism (40), the lower bearing (25*a*), and the upper bearing (26*a*), through the oil supply passage (39).

The housing (26) is formed in substantially a cylindrical shape having a large-diameter upper portion. The upper portion of the housing (26) is fixed to the barrel (21) of the casing (20). A recess as a crank chamber (27) is formed in the center of the upper portion of the housing (26). The eccentric portion (37) of the drive shaft (35) is housed in the crank chamber (27).

The compression mechanism (40) is configured as a scroll-type compression mechanism having a fixed scroll (41) and a movable scroll (51).

The fixed scroll (41) includes a fixed-side end plate (42), an outer rim portion (43), and a fixed-side wrap (44). The movable scroll (51) includes a movable-side end plate (52), a boss (53), and a movable-side wrap (54).

The fixed-side end plate (42) is formed in substantially a disk shape, and constitutes an upper end portion of the fixed scroll (41). A discharge port (55), and a discharge valve (56) for opening and closing the discharge port (55) are provided in an axial center portion of the fixed-side end plate (42). The refrigerant compressed by the compression mechanism (40) is discharged from the discharge port (55).

The outer rim portion (43) is integrally formed on the lower surface of an outer peripheral portion of the fixed-side end plate (42). The outer rim portion (43) is formed in substantially a cylindrical shape, and a lower portion thereof is fixed to the casing (20) via the housing (26).

The fixed-side wrap (44) is integrally formed on a portion of the fixed-side end plate (42) inward of the outer rim portion (43). The fixed-side wrap (44) is formed in a spiral shape standing upright on the lower surface of the fixed-side end plate (42). The fixed-side wrap (44) protrudes from the fixed-side end plate (42) toward the movable scroll (51) (downward). A spiral wrap groove (45) is formed in the lower surface of the fixed scroll (41) to extend along the wall surface of the fixed-side wrap (44).

The movable-side end plate (52) is formed in substantially a disk shape, and arranged to face the fixed-side end plate (42).

The boss (53) is integrally formed at a lower surface of a center portion of the movable-side end plate (52). The boss (53) is in the shape of a cylinder projecting downward, and is housed in the crank chamber (27). The eccentric portion (37) of the drive shaft (35) engages with the boss (53).

The movable-side wrap (54) is formed in a spiral shape standing upright on the upper surface of the movable-side end plate (52). The movable-side wrap (54) protrudes from the movable-side end plate (52) toward the fixed scroll (41) (upward), and is housed in the wrap groove (45) of the fixed scroll (41).

In the compression mechanism (40), the fixed-side wrap (44) and the movable-side wrap (54) mesh with each other. Thus, a compression chamber (57) in which a refrigerant is compressed is formed between the fixed-side wrap (44) and the movable-side wrap (54).

A discharge pipe (11) is connected to the casing (20). The discharge pipe (11) radially passes through the barrel (21) of the casing (20). An inflow end of the discharge pipe (11) opens in a lower space (12) of the housing (26).

<Suction Hole>

Figure 2:
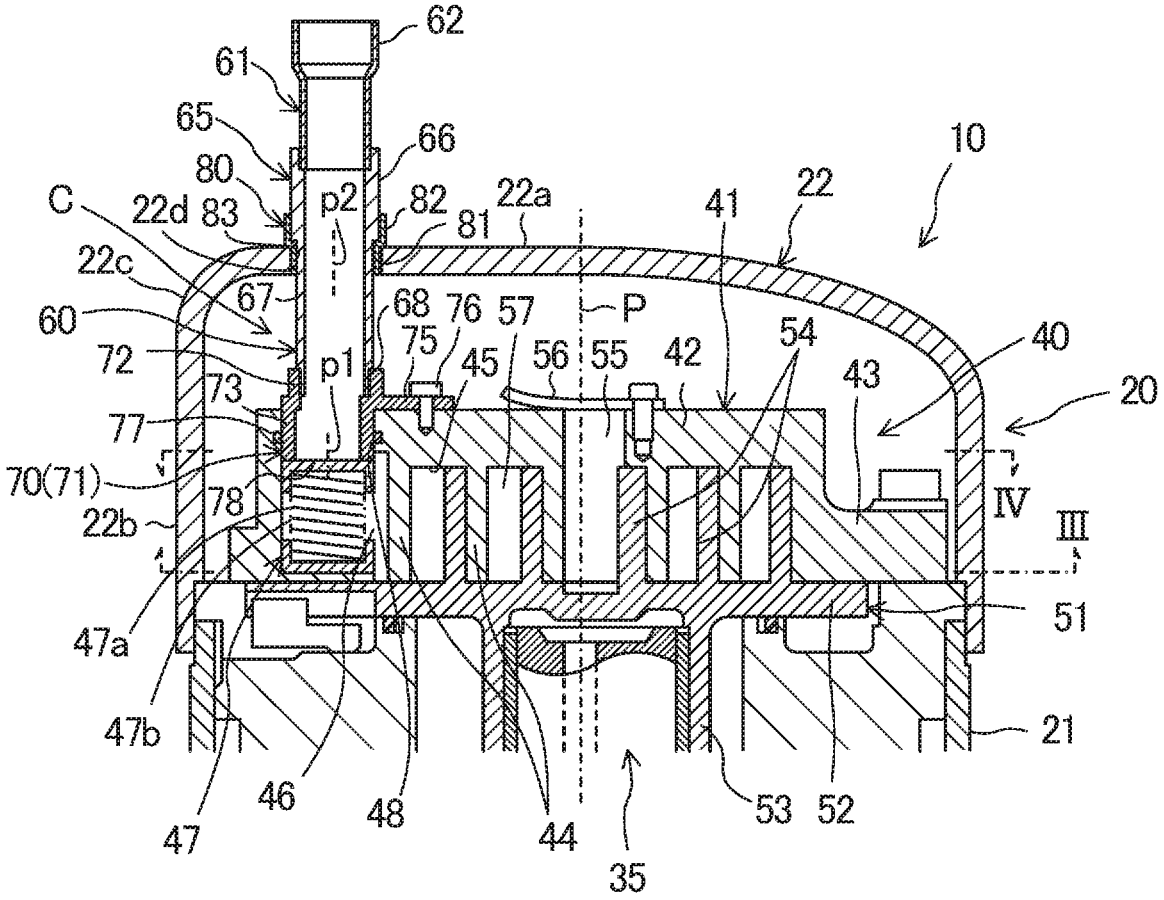
FIG. 2 is a vertical cross-sectional diagram illustrating a compression mechanism of a scroll compressor according to an embodiment in an enlarged scale.
Figure 3:
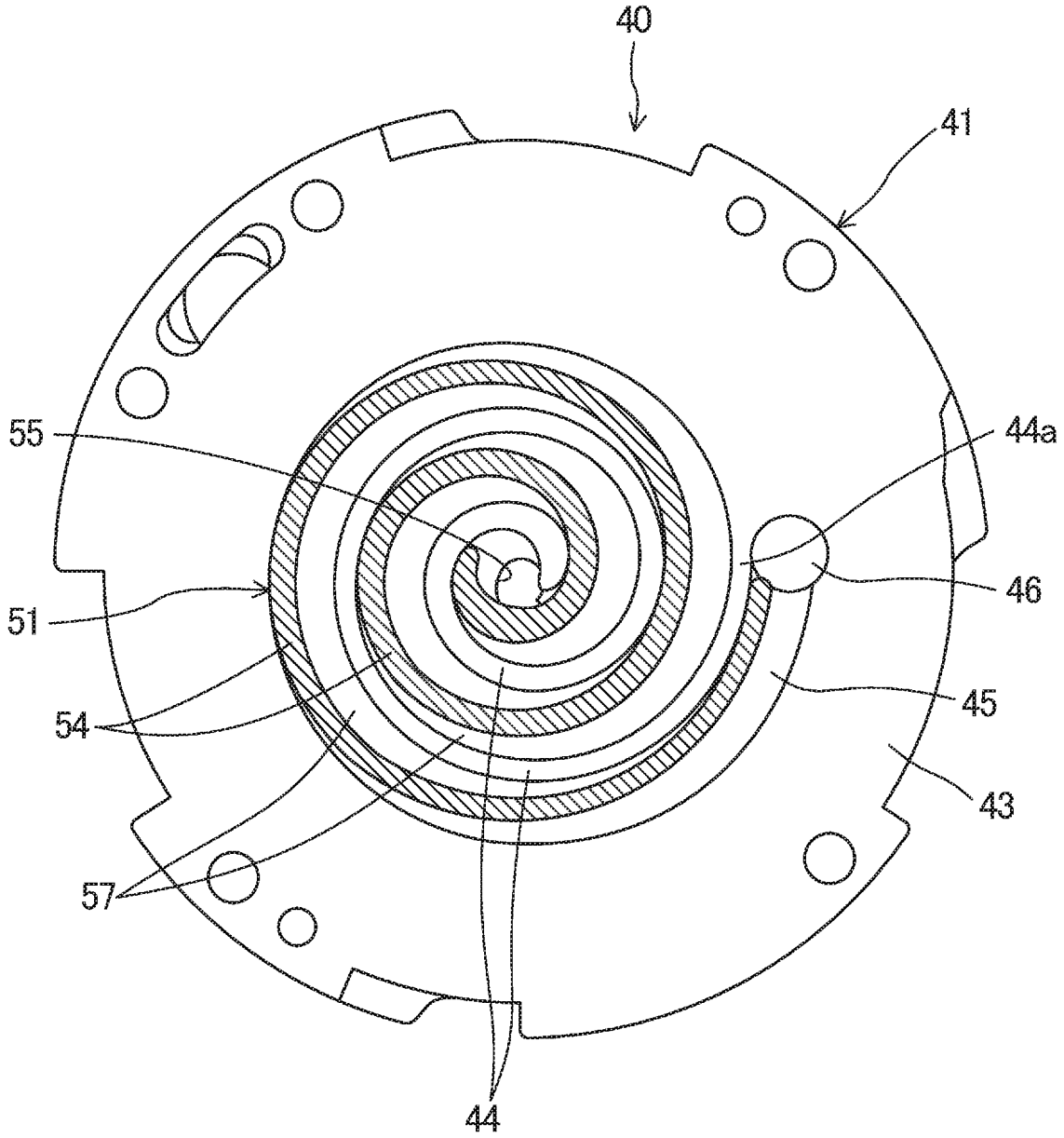
FIG. 3 is a cross-sectional diagram taken along line III-III of FIG. 2.

As shown in FIGS. 2 and 3, a suction hole (46) communicating with the compression chamber (57) is formed in the fixed scroll (41). The suction hole (46) is formed at a position corresponding to, or adjacent to, an outermost portion (44*a*) (winding end) of the fixed-side wrap (44). In other words, the suction hole (46) is formed between the outer rim portion (43) and the fixed-side wrap (44), and is continuous with the outermost portion of the wrap groove (45) (see FIG. 3).

As shown in FIG. 2, a suction passage (C) (which will be described in detail later) for introducing a fluid (low pressure refrigerant) outside the casing (20) into the compression chamber (57) of the compression mechanism (40) is connected to the suction hole (46). A suction valve (47) for opening and closing the suction passage (C) is provided for the suction hole (46). The suction valve (47) includes a valve body (47*a*) for opening and closing a terminal end of the suction passage (C), and a spring (47*b*) for biasing the valve body (47*a*) toward the suction passage (C). When the scroll compressor (10) is activated and the refrigerant flows through the suction passage (C), the suction valve (47) is displaced downward against the biasing force of the spring (47*b*) to open the suction passage (C). When the scroll compressor (10) is stopped, the suction valve (47) is displaced upward by the biasing force to close the suction passage (C).

<Detailed Configuration of Upper End Plate>

An upper end plate (22) shown in FIG. 2 constitutes a so-called casing top, through which a suction pipe (60) which will be described in detail later penetrates. The upper end plate (22) includes a flat portion (22*a*) forming a horizontal flat wall surface, and a peripheral wall portion (22*b*) forming a vertical cylindrical wall surface. The upper end plate (22) also has a bent portion (22*c*) (curved portion) which is curved to smoothly connect the flat portion (22*a*) and the peripheral wall portion (22*b*). That is, the bent portion (22*c*) is formed at an edge formed between the flat potion (22*a*) and the peripheral wall portion (22*b*).

The upper end plate (22) includes a pipe seat (80) for fixing the suction pipe (60). The pipe seat (80) is inserted into an insertion hole (22*d*) formed in the flat portion (22*a*) of the upper end plate (22). The pipe seat (80) includes a small-diameter cylindrical portion (81) fitted into the insertion hole (22*d*), and a large-diameter cylindrical portion (82) having a larger diameter than the small-diameter cylindrical portion (81). A lower surface of the large-diameter cylindrical portion (82) constitutes a stepped cylindrical surface which abuts on the upper surface of the upper end plate (22). A through hole (83) through which the suction pipe (60) passes is formed in the small-diameter cylindrical portion (81).

<Suction Passage>

The suction passage (C) of the present embodiment is formed of the suction pipe (60) including a plurality of pipe parts. The suction pipe (60) penetrates the upper end plate (22) of the casing (20). The suction pipe (60) of the present embodiment includes an introduction pipe (61), a main suction pipe (65), and a coupling pipe (71) arranged in this order from the upstream to downstream of the flow of the refrigerant.

The main suction pipe (65) constitutes an insertion pipe portion which is inserted into the through hole (83) of the upper end plate (strictly speaking, the pipe seat (80)). The main suction pipe (65) also constitutes an upstream pipe portion which extends vertically and is coaxial with the center (p2) of the through hole (83).

The main suction pipe (65) extends linearly along the direction of the axis (P) of the barrel (21) of the casing (20) (vertical direction in FIG. 3). The main suction pipe (65) has an enlarged portion (66), an intermediate portion (67), and a protruding portion (68) arranged in this order from the upstream to the downstream. The enlarged portion (66) is positioned outside the casing (20), and has a larger outer diameter than the intermediate portion (67). The intermediate portion (67) is inserted into the through hole (83) of the upper end plate (22) (strictly speaking, the pipe seat (80)), and extends downward inside the casing (20). The protruding portion (68) is present at a lower end of the main suction pipe (65), and has a smaller outer diameter than the intermediate portion (67).

The introduction pipe (61) is inserted into, and coupled to, a starting end of the main suction pipe (65). An upper portion of the introduction pipe (61) is formed into a large-diameter portion (62) in which the pipe diameter (outer diameter and inner diameter) of the introduction pipe (61) has been increased.

The coupling pipe (71) constitutes part of a coupling member (70) attached to the fixed-side end plate (42) of the fixed scroll (41). The coupling member (70) includes the coupling pipe (71), and a flange (75) protruding from an outer peripheral surface of the coupling pipe (71) toward the axis (P) of the barrel (21). The coupling pipe (71) and the flange (75) are integrally formed by, for example, casting. The flange (75) is in the shape of a flat plate extending horizontally to make contact with the upper surface of the fixed-side end plate (42), and is attached to the fixed scroll (41) with a fastening member (76).

The coupling pipe (71) includes a first pipe portion (72) and a second pipe portion (73). To the first pipe portion (72), the protruding portion (68) of the main suction pipe (65) is connected, and the flange (75) is coupled. The first pipe portion (72) is coaxial with the main suction pipe (65). The second pipe portion (73) is further shifted radially outward than the first pipe portion (72) with reference to the axis (P) of the barrel (21) of the casing (20). In other words, the second pipe portion (73) is located closer to the barrel (21) of the casing (20) than the first pipe portion (72).

The fixed-side end plate (42) of the present embodiment is provided with a vertical hole (48) extending vertically along the axis (P) of the barrel (21). The vertical hole (48) is located above the suction hole (46). The second pipe portion (73) of the coupling pipe (71) is inserted into the vertical hole (48). That is, the second pipe portion (73) constitutes an in-plate passage formed in the fixed-side end plate (42).

An outflow opening (78) which is open toward the suction hole (46) is formed at a lower end of the second pipe portion (73). The second pipe portion (73) constitutes a downstream pipe portion which extends vertically to be coaxial with the center (p1) of the outflow opening (78). A sealing member such as an O-ring (77) is interposed between the second pipe portion (73) and the vertical hole (48).

—Operation—

The operation of the scroll compressor (10) will be described below. When the electric motor (31) is energized, the drive shaft (35) is rotated together with the rotor (33) to rotate the movable scroll (51). The capacity of the compression chamber (57) periodically increases and decreases in accordance with the rotation of the movable scroll (51). Accordingly, the low pressure refrigerant sequentially flows through the introduction pipe (61) and the main suction pipe (65), and flows into the coupling pipe (71). Thereafter, the refrigerant sequentially flows through the first pipe portion (72) and the second pipe portion (73), and then is introduced into the suction hole (46).

The refrigerant in the suction hole (46) flows into the wrap groove (45), and is sent to the compression chamber (57) between the movable-side wrap (54) and the fixed-side wrap (44). When the movable scroll (51) is rotated to close the compression chamber (57), and the drive shaft (35) is further rotated, the capacity of the compression chamber (57) decreases, and the refrigerant is compressed in the compression chamber (57).

Thereafter, when the capacity of the compression chamber (57) further decreases, and the internal pressure of the compression chamber (57) communicating with the discharge port (55) exceeds a predetermined pressure, the discharge valve (56) is opened, and the high pressure refrigerant is discharged from the discharge port (55). This refrigerant enters the lower space (12) of the housing (26), and then is sent to the outside of the casing (20) through the discharge pipe (11).

<Positional Relationship Between Through Hole and Suction Passage>

Figure 4:
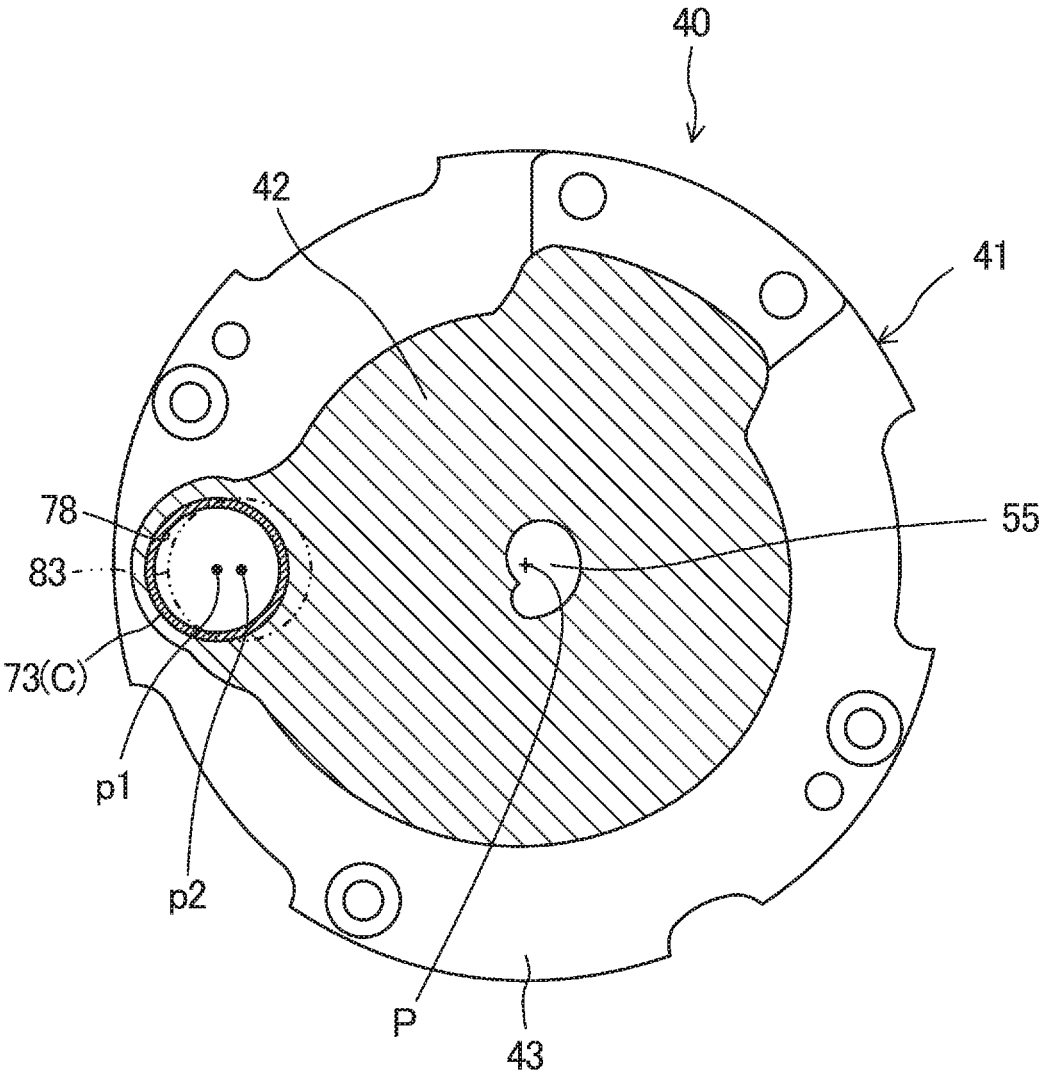
FIG. 4 is a cross-sectional diagram taken along line IV-IV of FIG. 2.

The position of the axis of the suction passage (C) of the scroll compressor (10) will be described in detail with reference to FIGS. 2 and 4.

In the scroll compressor (10) of the present embodiment, the center (p1) of the outflow opening (78), which is the terminal end of the suction passage (C), and the center (p2) of the through hole (83) of the upper end plate (22) are shifted from each other in the radial direction. Specifically, the center (p2) of the through hole (83) is closer to the axis (P) of the barrel (21) than the center (p1) of the outflow opening (78) of the suction passage (C). Here, the second pipe portion (73) is coaxial with the center (p1) of the outflow opening (78). The introduction pipe (61), the main suction pipe (65), and the first pipe portion (72) are coaxial with the center (p2) of the through hole (83). Therefore, in this embodiment, the axes of the introduction pipe (61), the main suction pipe (65), and the first pipe portion (72) are closer to the axis (P) of the barrel (21) than the axis of the second pipe portion (73).

This can enlarge the compression mechanism (40) of the present embodiment radially outward, and can facilitate processing required for the connection of the suction pipe (60).

Specifically, when the fixed scroll (41) and the movable scroll (51) are increased in size in the radially outward direction with the increase in the capacity of the compression mechanism (40), the compression chamber (57) is also enlarged in the radial direction. As a result, the suction hole (46) adjacent to the outermost end of the fixed-side wrap (44) is also brought close to the barrel (21) of the casing (20). In a case in which the suction pipe extending straight in the vertical direction is configured to be connected to the suction hole (46), the position of the through hole (83) of the upper end plate (22) through which the suction pipe passes is also brought close to the barrel (21) of the casing (20). Thus, the through hole (83) becomes close to the bent portion (22*c*) of the upper end plate (22), which makes processing required for the connection of the suction pipe difficult.

In contrast, in the present embodiment, the main suction pipe (65) penetrating the upper end plate (22) is closer to the axis (P) of the barrel than the second pipe portion (73) connected to the suction hole (46). Therefore, in this embodiment, the through hole (83) formed in the upper end plate (22) is brought close to the axis (P) of the barrel (21). This can avoid interference between the through hole (83) and the bent portion (22*c*), and enables the formation of the through hole (83) in the flat portion (22*a*). This can facilitate various types of processing, such as machining of the insertion hole (22*d*) in the upper end plate (22), attachment and welding of the pipe seat (80), and brazing of the main suction pipe (65).

Advantages of Embodiment

According to the embodiment described above, the center (p2) of the through hole (83) of the upper end plate (22) is located closer to the axis (P) of the barrel (21) than the center (p1) of the outflow opening (78) of the suction passage (C). Thus, even if the suction hole (46) of the compression mechanism (40) is shifted radially outward, the outflow opening (78) of the suction passage (C) can be reliably connected to the suction hole (46). Further, this can avoid the pipe seat (80) or the through hole (83) from interfering with the bent portion (22*c*) of the upper end plate (22), and can facilitate the connection of the pipe to the upper end plate (22).

<First Variation>

Figure 5:
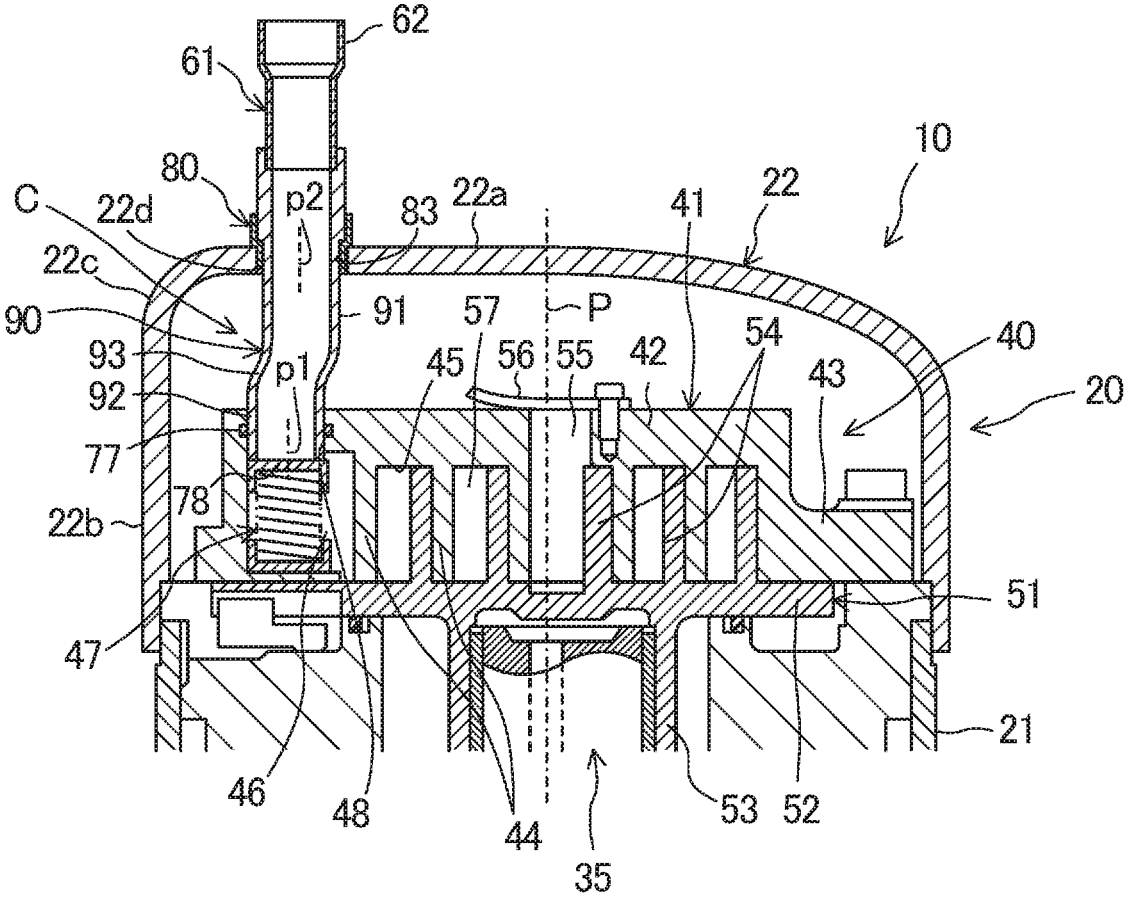
FIG. 5 is a diagram corresponding to FIG. 2, illustrating a first variation.

A first variation shown in FIG. 5 is different from the above-described embodiment in the configuration of the suction passage (C). Specifically, the suction passage (C) of the first variation constitutes a single suction connection pipe (90) formed of the main suction pipe (65) and coupling pipe (71) of the embodiment integrated together. The suction connection pipe (90) includes an upstream pipe portion (91) (insertion pipe portion) which is straight and inserted into the through hole (83), a downstream pipe portion (92) (in-plate passage) which is straight and connected to the vertical hole (48) of the fixed-side end plate (42), and an intermediate pipe portion (93) connecting the upstream pipe portion (91) and the downstream pipe portion (92). The upstream pipe portion (91) extends in the vertical direction to be coaxial with the center (p2) of the through hole (83). The downstream pipe portion (92) extends in the vertical direction to be coaxial with the center (p1) of the outflow opening (78). The intermediate pipe portion (93) extends obliquely so as to approach the barrel (21) as it goes downward.

Also in the first variation, the center (p2) of the through hole (83) is closer to the axis (P) of the barrel (21) than the center (p1) of the outflow opening (78) of the downstream pipe portion (92). Thus, even if the compression mechanism (40) is enlarged radially outward, the outflow opening (78) of the downstream pipe section (92) can be connected to the suction hole (46). This can avoid the pipe seat (80) or the through hole (83) from interfering with the bent portion (22*c*) of the upper end plate (22).

<Second Variation>

Figure 6:
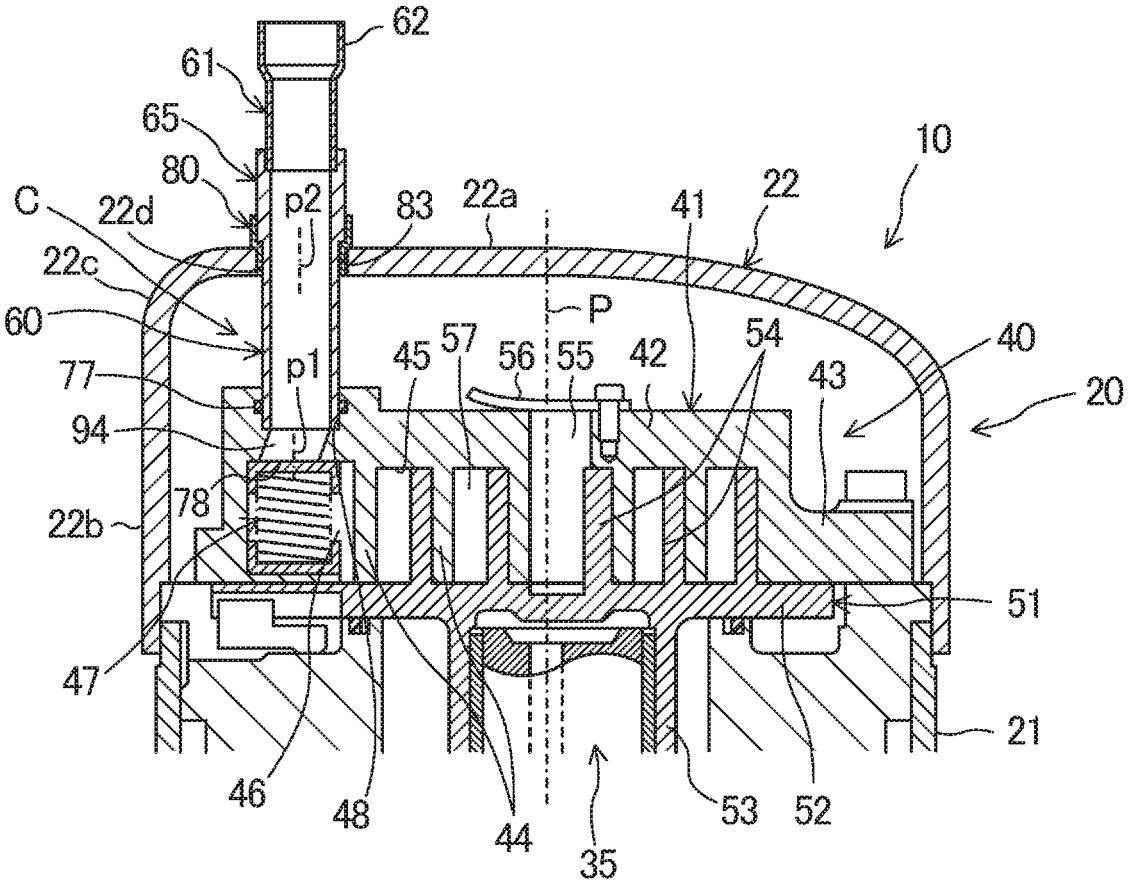
FIG. 6 is a diagram corresponding to FIG. 2, illustrating a second variation.

A second variation shown in FIG. 6 is different from the embodiment described above in the configuration of the suction passage (C). Specifically, the suction passage (C) of the second variation includes the suction pipe (60) and a suction communication passage (94) which are continuous with each other. The suction pipe (60) of the second variation includes an introduction pipe (61) and a main suction pipe (65) which are similar to those of the above-described embodiment.

In the second variation, a suction communication passage (94) as an in-plate passage is formed inside the fixed-side end plate (42). Specifically, the suction communication passage (94) extends obliquely so as to approach the barrel (21) as it goes downward. A lower end of the suction communication passage (94) constitutes an outflow opening (78) which opens toward the suction hole (46).

Also in the second variation, the center (p2) of the through hole (83) is closer to the axis (P) of the barrel (21) than the center (p1) of the outflow opening (78) of the suction communication passage (94). Therefore, even if the compression mechanism (40) is enlarged radially outward, the outflow opening (78) of the suction communication passage (94) can be connected to the suction hole (46). This can avoid the pipe seat (80) or the through hole (83) from interfering with the bent portion (22*c*) of the upper end plate (22).

Other Embodiments

In the above-described embodiment, the through hole (83) is formed in the pipe seat (80) provided on the upper end plate (22). However, the through hole (83) may be directly formed in the wall surface of the upper end plate (22). In this case as well, the center of the through hole (83) is brought closer to the axis (P) of the barrel (21) than the center (p1) of the outflow opening (78) of the suction passage (C). Therefore, the same advantages as those described above can be achieved.

The present invention is useful as a scroll compressor.

What is claimed is:

1. A scroll compressor, comprising:

a casing having a cylindrical barrel and a lid attached to an axial end of the barrel;

a compression mechanism having a fixed scroll and a movable scroll, the compression mechanism being housed in the casing; and a suction passage configured to send a fluid outside the casing into a compression chamber of the compression mechanism, the fixed scroll including a fixed-side end plate, a fixed-side wrap standing upright on the fixed-side end plate, and a suction hole formed in a portion corresponding to an outermost portion of the fixed-side wrap, the suction hole being capable of communicating with the compression chamber, the suction passage including an insertion pipe passage defined by an insertion pipe portion inserted into a through hole of the lid of the casing, and an in-plate passage formed in the fixed-side end plate and having an outflow opening opened toward the suction hole, a center of the through hole being closer to an axis of the barrel than a center of the outflow opening of the in-plate passage, and the suction passage being positioned entirely radially outward of a radially inward edge of the through hole, closest to the axis of the barrel.

2. The scroll compressor of claim 1, wherein the insertion pipe portion includes an upstream pipe portion extending coaxially with the center of the through hole, and the in-plate passage includes a downstream pipe portion displaced toward the barrel with respect to the upstream pipe portion so as to be coaxial with the center of the outflow opening.

3. The scroll compressor of claim 2, wherein the upstream pipe portion and the downstream pipe portion are different members.

4. The scroll compressor of claim 1, wherein part of the through hole and part of the outflow opening axially overlap with each other.

5. The scroll compressor of claim 1, wherein the suction passage includes a main suction pipe, which is straight and configures the insertion pipe portion, and a coupling pipe including a first pipe portion, which is straight and connected to the main suction pipe, and a second pipe portion, which is straight, shifted radially outward relative to the first pipe portion, and communicates with the outflow opening.

6. The scroll compressor of claim 1, wherein the suction passage is configured as one suction connection pipe, and the suction connection pipe includes an upstream pipe portion, which is straight and configures the insertion pipe portion, a downstream pipe portion, which is straight, shifted radially outward relative to the upstream pipe portion, and communicating with the outflow opening, and an intermediate pipe portion connecting the upstream pipe portion and the downstream pipe portion, and the intermediate pipe portion extending obliquely so as to approach the barrel as the intermediate pipe portion extends toward the outflow opening.

7. The scroll compressor of claim 1, wherein the suction passage includes a main suction pipe, which is straight and configures the insertion pipe portion, and a suction communication passage formed inside the fixed-side end plate and extending obliquely so as to approach the barrel as the suction communication passage extends toward the outflow opening.

* * * * *